US006286330B1

(12) United States Patent
Kopf

(10) Patent No.: US 6,286,330 B1
(45) Date of Patent: Sep. 11, 2001

(54) REFRIGERATOR AIR FILTER

(75) Inventor: Bruce A. Kopf, Cedar Rapids, IA (US)

(73) Assignee: Amana Company, L.P., Houston, TX (US)

( * ) Notice: Subject to any disclaimer, the term of this patent is extended or adjusted under 35 U.S.C. 154(b) by 0 days.

(21) Appl. No.: 09/526,915

(22) Filed: Mar. 16, 2000

(51) Int. Cl.[7] ..... F28D 5/00
(52) U.S. Cl. ..... 62/314; 62/441
(58) Field of Search ..... 62/314, 441, 78, 62/317

(56) References Cited

U.S. PATENT DOCUMENTS

| | | | | |
|---|---|---|---|---|
| D. 372,770 | | 8/1996 | Foreman . | |
| 2,206,705 | * | 7/1940 | Newman | 62/89 |
| 2,317,816 | | 4/1943 | Scott . | |
| 2,317,840 | | 4/1943 | Wild . | |
| 3,950,157 | * | 4/1976 | Matney | 55/490 |
| 5,078,971 | | 1/1992 | Matuda . | |
| 5,230,220 | | 7/1993 | Kang . | |
| 5,501,084 | | 3/1996 | Chang . | |
| 5,568,730 | | 10/1996 | Kim . | |
| 5,716,115 | * | 2/1998 | Anoszko | 312/265.6 |
| 5,772,959 | * | 6/1999 | Bermas | 422/5 |
| 6,099,612 | * | 8/2000 | Bartos | 55/481 |

* cited by examiner

*Primary Examiner*—Henry Bennett
*Assistant Examiner*—Mel Jones
(74) *Attorney, Agent, or Firm*—Bracewell & Patterson, L.L.P.

(57) ABSTRACT

An air filter system for refrigerators includes an economically and easily manufactured housing having a replaceable air filter supported within the housing, and a releasable connector associated with the housing permits the housing of the air filter system to be readily and easily removed from the refrigerator, to permit the easy replacement of the air filter.

28 Claims, 3 Drawing Sheets

FIG. 1
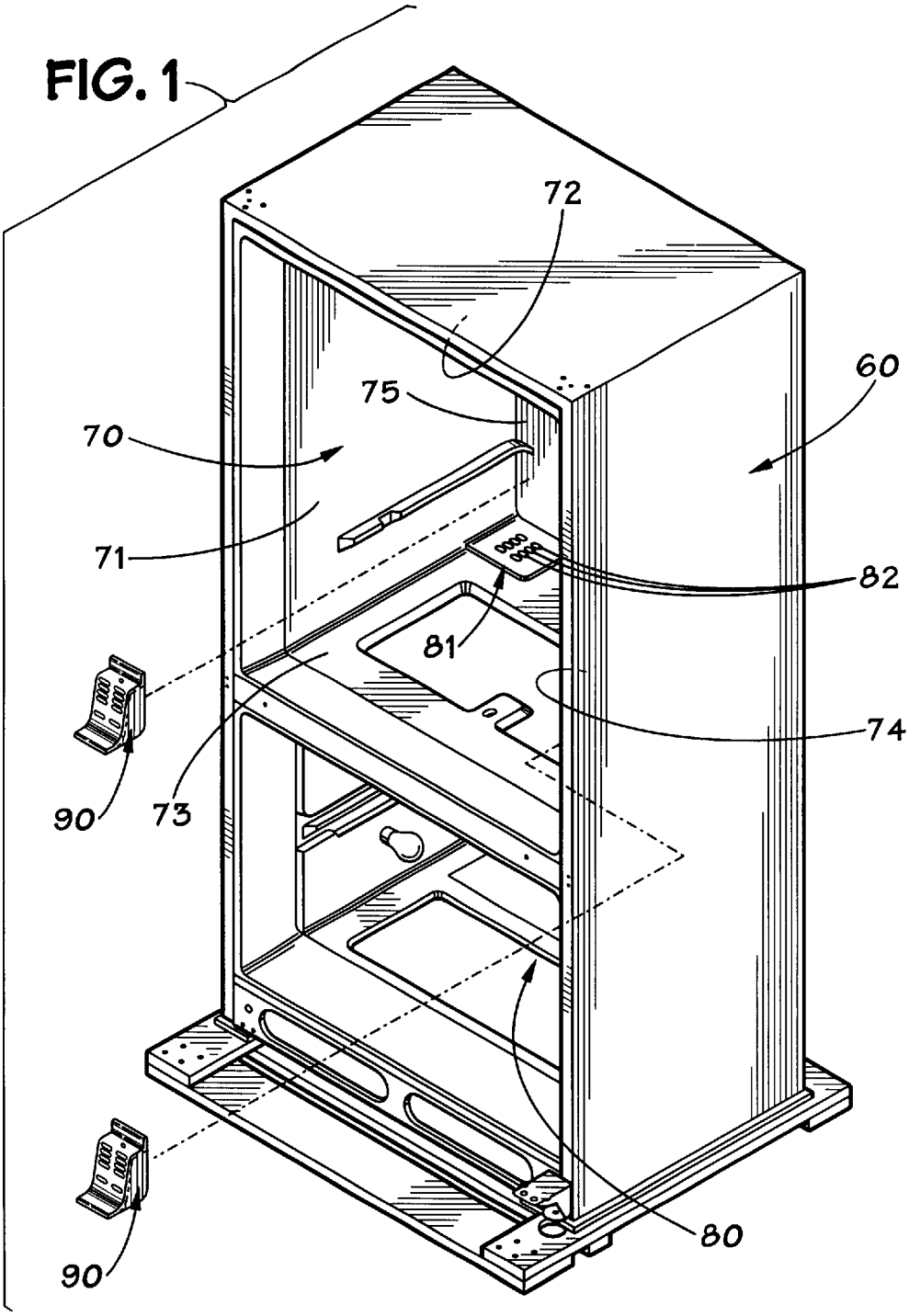
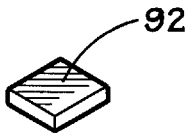
FIG. 1A

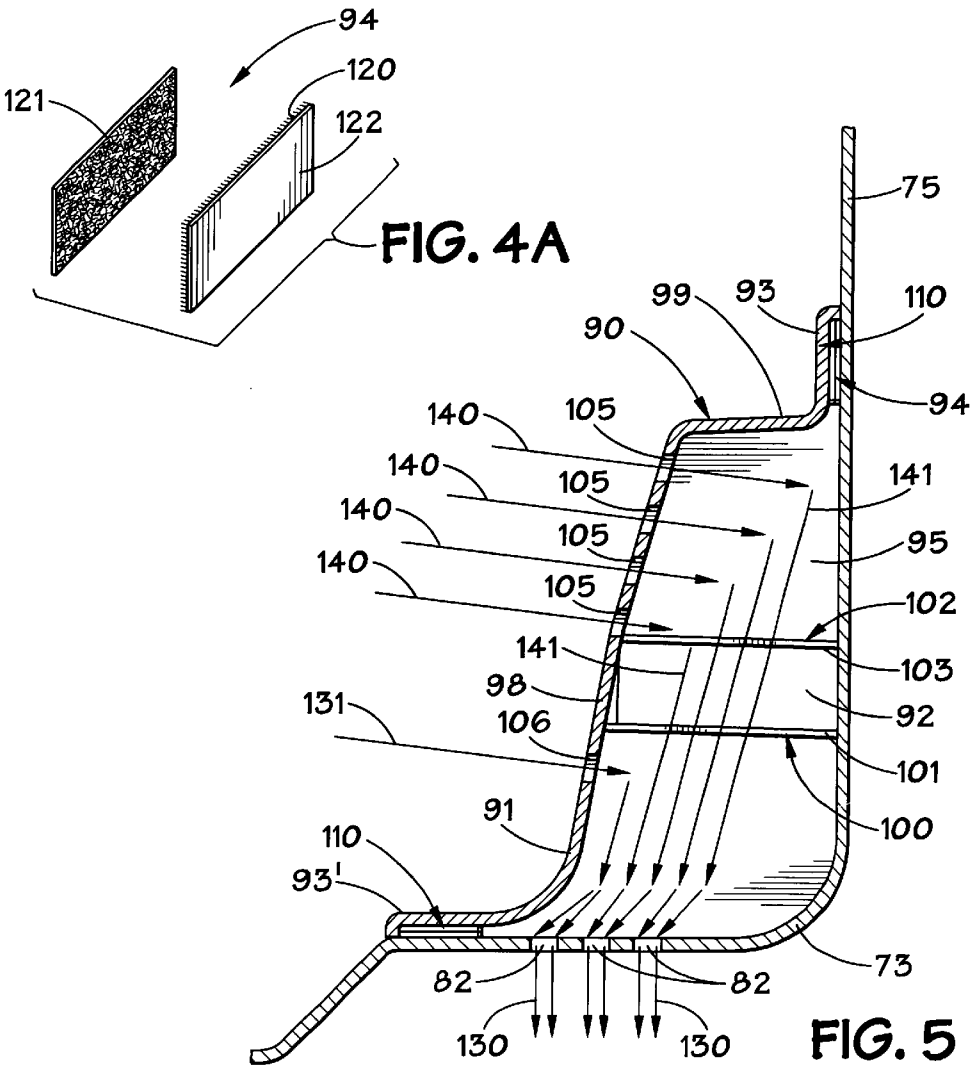
FIG. 4A
FIG. 5
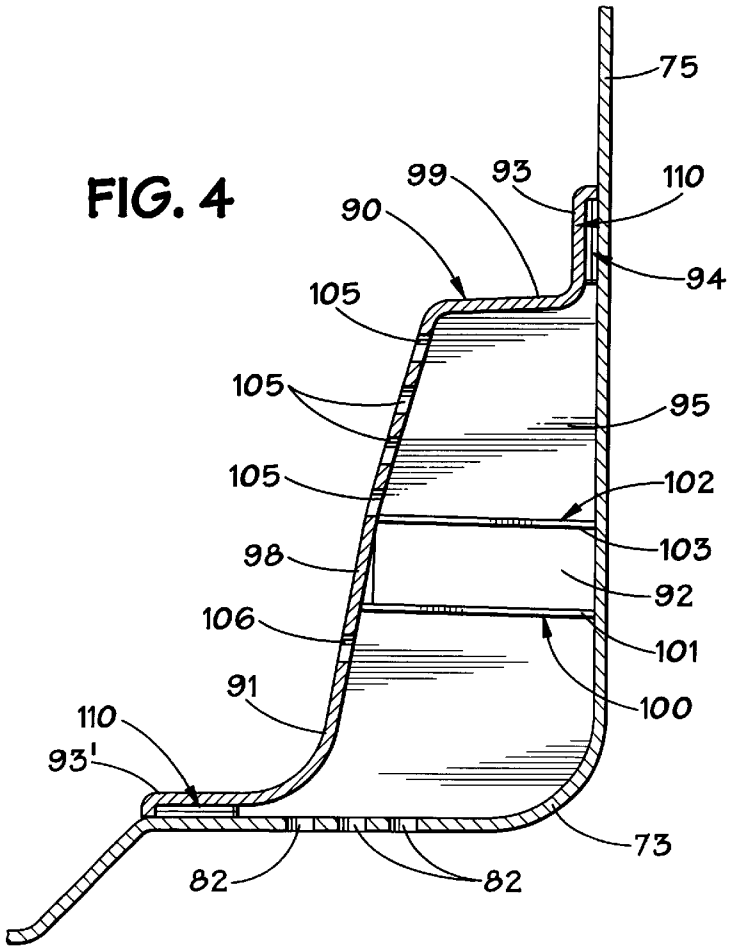
FIG. 4

REFRIGERATOR AIR FILTER

BACKGROUND OF THE INVENTION

1. Field of the Invention

The invention relates to an air filter system for use in a refrigerator, and a refrigerator having an air filter system which filters air flowing between the fresh food compartment of the refrigerator into the freezer compartment of the refrigerator.

2. Description of Related Art

Various devices have been proposed over the years to filter air from the refrigerated, fresh food compartment of a refrigerator, to reduce food odors in the compartments of the refrigerator, as well as reduce odors in the air flowing back into the freezer compartment. By reducing food odors in the refrigerated, fresh food compartment of a refrigerator, odors in ice made in the freezer compartment, as well as the taste of such ice is improved.

Such devices have included fans, glow discharge lamps, ozone decomposing catalysts, deodorant blocks, particles of activated carbon, and ultraviolet lamps operative to radiate an ultraviolet ray to a photocatalyst layer, among others. Additionally, some refrigerators manufactured in Japan utilize a ceramic filter built into the refrigerator; however, the filter is not changeable, and only lasts approximately seven years. The present devices of the types previously described have many disadvantages since: they generally include many parts and components; the filter, or deodorant device, is not easily and readily changed by the user of the refrigerator, or may not be changed at all; and they are not inexpensive to manufacture.

Accordingly, prior to the development of the present invention, there has been no air filter system or refrigerator having an air filter system, which: includes a small number of parts and components; is easily and readily changed by the user of the refrigerator; and is inexpensive to manufacture and use. Therefore, the art has sought an air filter system, and a refrigerator having an air filter system, which: includes few parts and components; has a filter which is easily and readily changed by the user of the refrigerator; and is inexpensive to manufacture and use.

SUMMARY OF INVENTION

In accordance with the invention, the foregoing advantages have been achieved through the present air filter system for use in a refrigerator having a fresh food compartment, having a plurality of planar wall surfaces, and a freezer compartment with an air return passageway disposed in fluid communication between the fresh food compartment and the freezer compartment. The air filter system for filtering at least some of the air flowing from the fresh food compartment through the air return passageway into the freezer compartment, of the present invention, may include: a housing having an interior defined by a plurality of wall members formed integral with each other, each wall member having an inner surface and an outer surface; at least two of the wall members having integrally formed on each of their inner surfaces at least one support member; a replaceable air filter supported by the at least two support members, the air filter being disposed intermediate at least one opening formed in the housing and the air return passageway; at least one mounting member formed integral with at least one wall member, the at least one mounting member having a mounting surface lying in a plane which is substantially coplanar with at least one of the planar wall surfaces of the fresh food compartment; and a releasable connector disposed on the mounting surface of the at least one mounting member which releasably connects the housing to at least one of the planar wall surfaces of the fresh food compartment, whereby upon disconnecting the housing from the fresh food compartment, the air filter may be easily replaced.

A feature of the present invention is that the replaceable air filter may be: a ceramic filter; a charcoal filter; or a carbon filter. Another feature of the present invention is that the carbon filter may be polypropylene fibers impregnated with carbon. The replaceable air filter may have a generally rectangular shape.

A further feature of the present invention is that the releasable connector may include hook and loop fasteners, at least one of the hook or loop fasteners secured to the mounting surface of the at least one mounting member and at least one of the other hook or loop fasteners may be adapted to be secured to at least one of the planar walls surfaces of the fresh food compartment. Another feature of the present invention is that the housing may include two mounting members, and a releasable connector is disposed on each mounting surface of each mounting member. An additional feature of the present invention is that the at least one mounting member may extend outwardly from the at least one wall member, or it may extend inwardly into the housing.

An additional feature of the present invention is that the wall members defining the housing may include two sidewall members and a front wall member. The inner surface of each sidewall member may have at least one support member integrally formed thereon. A further feature of the present invention is that the support members may be disposed substantially perpendicular to a substantially perpendicularly disposed planar wall surface of the fresh food compartment. An additional feature of the present invention is that there may be tipper and lower support members formed internally on the inner surface of each side wall member.

The air filter system, and refrigerator having an air filter system, of the present invention, when compared with previously proposed refrigerator air filter systems, have the advantages of: including few parts and components; the air filter may be easily and readily changed by the user of the refrigerator; and the air filter system may be easily and economically manufactured.

BRIEF DESCRIPTION OF DRAWINGS

FIG. 1 is a perspective view of a refrigerator in accordance with the present invention;

FIG. 1A is a perspective view of an air filter in accordance with the present invention;

FIG. 4 is a partial cross-sectional view similar to FIG. 3;

FIG. 4A is a perspective view of a releasable connector in accordance with the present invention; and FIG. 5 is a partial cross-sectional view of the air filter system of the present invention, similar to FIGS. 3 and 4, and illustrating air flow through the air filter system.

Figure 3:
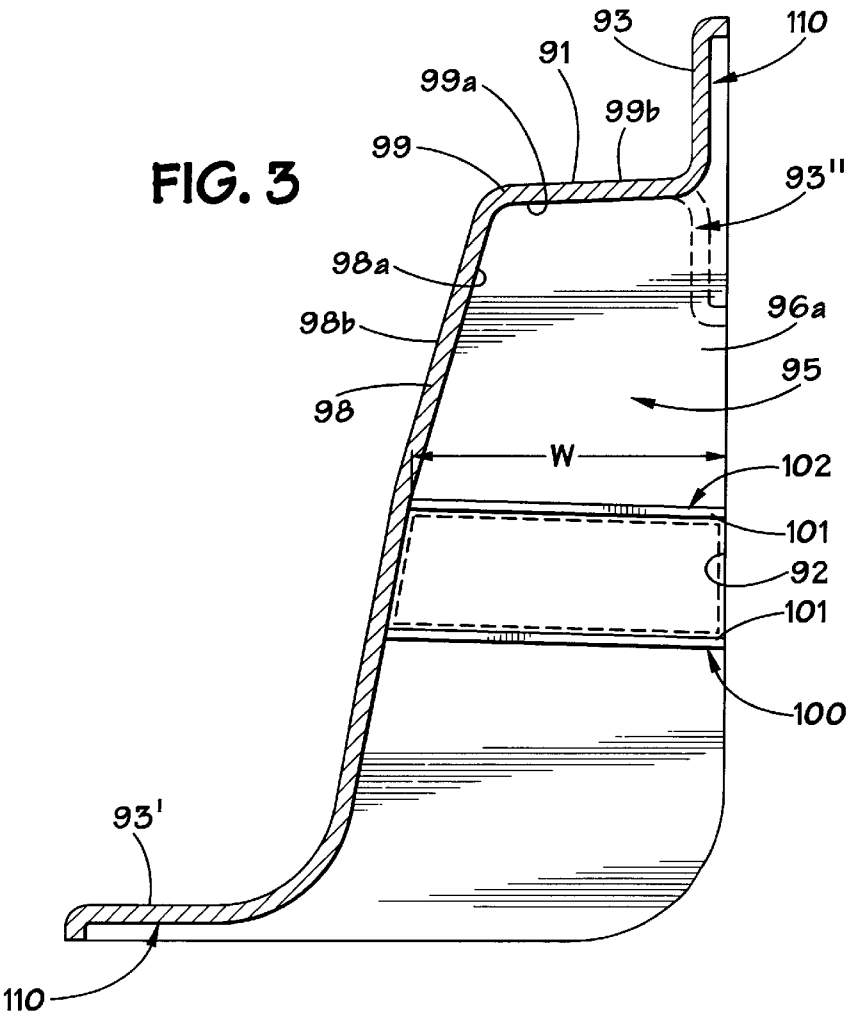
FIG. 3 is a cross-sectional view taken along line 3—3 of FIG. 2.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION AND SPECIFIC EMBODIMENTS OF THE INVENTION

In FIG. 1, a refrigerator 60 of the present invention, is shown to generally include a refrigerated, fresh food compartment 70, having a plurality of planar wall surfaces 71, 72, 73, 74, and 75, the door of refrigerator 60 not being shown for drawing clarity purposes. Refrigerator 60 further includes a freezer compartment 80, and an air return passageway 81 is disposed in the lower, or bottom, wall surface 73 of fresh food compartment 70, and air return passageway 81 is in turn disposed in fluid communication between fresh food compartment 70 and freezer compartment 80, as is known in the art. At least one air filter system 90, and in the case of refrigerator 60, two air filter systems 90 are illustrated (in an exploded fashion in FIG. 1) for filtering at least some of the air flowing from the fresh food compartment 70 through the air return passageways 81, into the freezer compartment 80. The return air passageway 81 preferably includes a plurality of openings 82, which openings are disposed in one of the planar wall surfaces of the fresh food compartment 70, in preferably the bottom, or lower, planar wall surface 73 of fresh food compartment 70.

With reference to FIGS. 2–5, the air filter system 90 will be described in greater detail. It should be noted that for drawing clarity, certain of the planar wall surfaces of the fresh food compartment 70 are not illustrated in FIGS. 2 and 3, but are illustrated in FIGS. 4 and 5. In this regard, in FIGS. 4 and 5, air filter system 90 is connected to at least one of the planar wall surfaces of the fresh food compartment 70, such as the rear, or back, planar wall surface 75 of fresh food compartment 70. Additionally, as illustrated in FIGS. 4 and 5, air filter system 90 is also connected to the bottom, or lower, planar wall surface 73 of fresh food compartment 70, with the openings 82 of air return passageway 81 being illustrated in FIGS. 4 and 5 as being disposed in the lower, or bottom, planar wall surface 73 of fresh food compartment 70.

Figure 2:
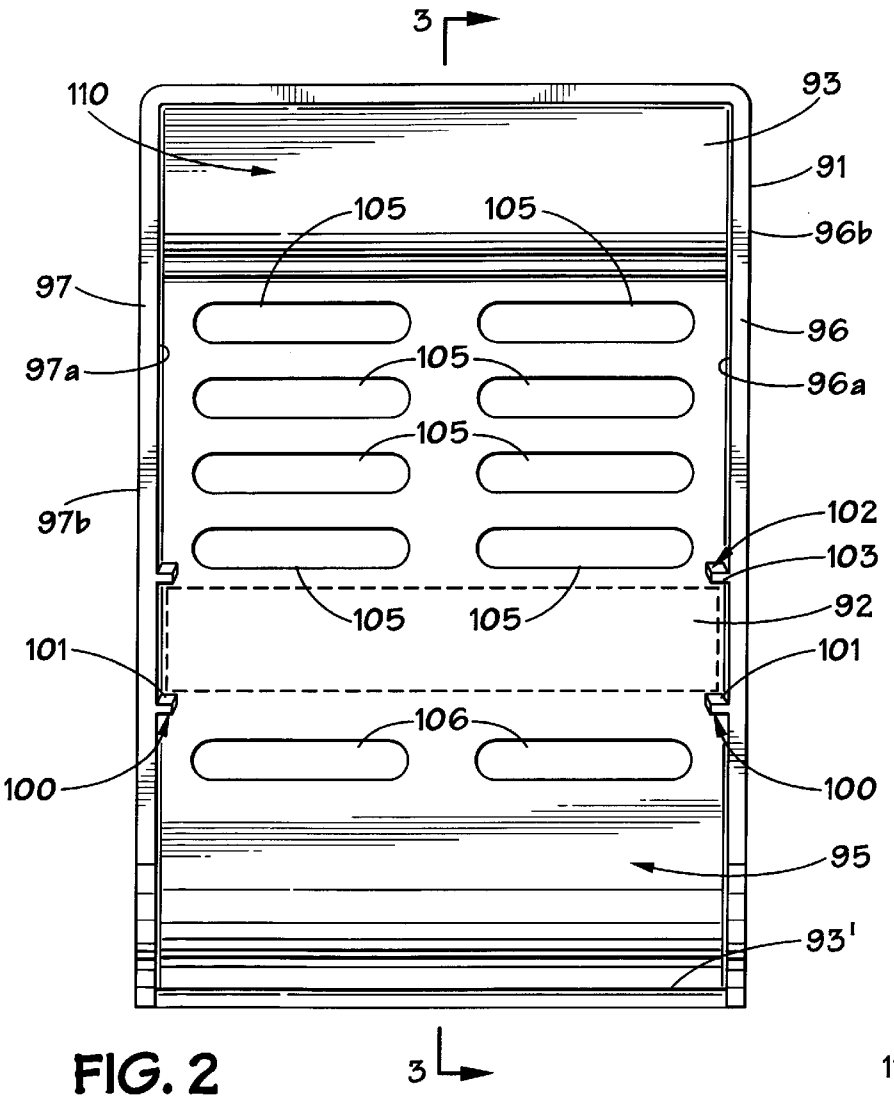
FIG. 2 is a rear view of an air filter system in accordance with the present invention.

With reference to FIGS. 2–5, air filter system 90, for filtering at least some of the air flowing from the fresh food compartment 70 through the openings 82 of air return passageway 81 (FIG. 1) into the freezer compartment 80, generally includes: a housing 91; a replaceable air filter 92 (shown in dotted lines in FIGS. 2 and 3); at least one mounting member 93; and a releasable connector 94 (FIGS. 4 and 5). Housing 91 generally has an interior 95 defined by a plurality of wall members 96, 97, 98, and 99 formed integral with each other. Each wall member 96–99 has an inner surface, the inner walls bearing subscript "a", and the outer surfaces bearing a subscript "b" throughout the figures. As best seen in FIGS. 2 and 3, at least two of the wall members have integrally formed on each of their inner surfaces at least one support member 100. Preferably, housing 91 includes two sidewall members 96, 97 and a front wall member 98, and the inner surface 96*a*, 97*a* of each sidewall member 96, 97, has the at least one support member 100 integrally formed thereon. In the preferred embodiment, an upper front wall member 99 may also be provided, as shown in FIGS. 3–5. The at least one support member 100 is preferably an integrally formed rib member 101 which extends inwardly toward the interior 95 of housing 91. As seen in FIGS. 4 and 5, the support members 100, or ribs 101, are preferably disposed substantially perpendicular to a substantially perpendicularly disposed planar wall surface 75 of the fresh food compartment 70. As seen in FIGS. 2–5, preferably additional support members are formed internally on the inner surface of each sidewall member, whereby there is a lower support member 100 and a corresponding upper support member 102, which may be a similarly formed inwardly extending rib member 103. Preferably, housing 91 is formed of a conventional plastic material such as polyethylene, polypropylene, ABS, or other suitable plastic material, which may be molded into the desired configuration in a conventional manner.

Still with reference to FIGS. 2–5, it is seen that the replaceable air filter 92 is supported by the at least two support members 100 within housing 91. As will be hereinafter described in greater detail, housing 91 includes at least one opening, and preferably a plurality of openings 105, which are illustrated in the preferred embodiment to be disposed in the front wall member 98. Additional openings 106 may also be provided in housing 91, which openings 106 are illustrated disposed in the front wall 98 of housing 91. As seen in FIGS. 2–5, the replaceable air filter 92 is disposed intermediate at least one of the openings 105 formed in the housing and the openings 82 of air return passageway 81.

Still with reference to FIGS. 2–5, air filter system 90 includes at least one mounting member 93 formed integral with at least one wall member of housing 91. As illustrated in FIGS. 2–5, the at least one mounting member 93 is formed integral with the front upper wall member 99. In the preferred embodiment of air filter system illustrated in FIGS. 2–5, another mounting member 93' is provided, and mounting member 93' is formed integral with the lower portion of front wall member 98. Mounting members 93 and 93' have a mounting surface 110 which lies in a plane which is substantially coplanar with at least one of the planar wall surfaces of the fresh food compartment 70. As illustrated in FIGS. 2–5, the mounting surface 110 of mounting member 93 is disposed substantially coplanar, or parallel, with the rear planar wall surface 75 of fresh food compartment 70, and the mounting surface 110 of mounting member 93' is disposed substantially coplanar, or substantially parallel with the bottom, or lower, planar surface 73 of fresh food compartment 70.

Still with reference to FIGS. 2–5, a releasable connector 94 is disposed on at least one of the mounting surfaces 110 of the at least one mounting member 93, 93', and the releasable connector 94 releasably connects the housing 91 to at least one of the planar wall surfaces of the fresh food compartment 70. In the preferred embodiment, releasable connectors includes hook and loop fasteners 120, 121 (FIG. 4A), which are commercially available in mating pairs, sold under the trademark VELCRO®. The hook portions of hook fastener 120 may be disposed on one side of hook fastener, and a conventional adhesive 122 may be disposed on the other side. Similarly, the loop fastener includes the loop portions disposed on one side of loop fastener 121 and an adhesive (not shown), is disposed on the other side of the loop fastener, as illustrated in FIG. 4A. Either the hook or loop fasteners 120, 121, may be secured to the mounting surface 110 of the at least one mounting member 93, and the other hook or loop fastener 120, 121, is secured to at least one of the planar wall surfaces of the fresh food compartment 70, as illustrated in FIGS. 4 and 5. Preferably, a releasable connector 94 is also utilized in connection with mounting member 93'. By use of releasable connector, or connectors 94, housing 91 of air filter system 90 may be readily, and easily, disconnected from the fresh food compartment 70, and as will be hereinafter described, the air filter 92 may be easily replaced.

Still with reference to FIGS. 2–5, the at least one mounting member 93 may extend outwardly from the at least one wall member, or front, upper wall member 92. Also as shown in FIGS. 2–5, the second mounting member 93' similarly extends outwardly from the front wall member 98. Alternatively, if desired, the at least one mounting member 93 may extend inwardly into housing 91 as shown at 93" in dotted lines in FIG. 3.

With reference to FIGS. 1A and 2–5, it is seen that air filter 92 has a generally thin, rectangular shape, and rests upon support member 100. Alternatively, if upper and lower support members 100, 102 are used, replaceable air filter 92 is received within, and supported by, the upper and lower support members 100, 102. Replaceable air filter 92 may be a ceramic filter, charcoal filter, or a carbon filter. Preferably, replaceable air filter 92 is a carbon filter which is made of polypropylene fibers impregnated with carbon. With reference to FIGS. 4 and 5, air flow through openings 105 is indicated by arrows 140 in FIG. 5. Upon air being drawn into the freezer compartment 80, via openings 82 of return air passageway 81, as shown by arrows 130, air is drawn through at least one, and preferably a plurality, of openings 105 into the interior 95 of housing 91, as illustrated by arrows 120 in FIG. 5. The air is then drawn through filter 92, as shown by arrows 141 in FIG. 5 and then through openings 82. The air, upon passing through filter 92, is filtered and odors from the fresh food compartment 70 become entrapped in filter 92. If desired, openings 106 may serve as an air inlet bypass into the interior 95 of housing 91, as shown by arrow 131. Thus, if filter 92 becomes clogged, adequate air flow may still be permitted to return to freezer compartment 80, until the user of the refrigerator 60 can remove housing 91 and replace the air filter 92 with a fresh air filter 92.

It should be noted that various modification and equivalents to the invention will be apparent to one skilled in the art. For example, the shape of housing 91 could readily be varied, as well as the number of integrally formed wall members. For example, the front, upper wall member 99 could be deleted and just a front wall member 98 could be utilized, whereby the housing 91 would have a generally triangular shape, when viewed from the side as in FIGS. 4 and 5. Similarly, only one mounting member 93 could be utilized either at the top or bottom of housing 91. Additionally, if the openings 82 of air return passageway 81 were disposed in the rear planar wall surface 75 of fresh food compartment 70 of refrigerator 60, the present air filter system 90 of the present invention would similarly work, which may be illustrated by rotating 90 degrees the housing of FIG. 4, and envisioning planar wall surface 73 of fresh food compartment 70 as being the rear planar wall surface 75. Similarly, the openings 82 of air return passageway 81 could be disposed in a side wall surface 71 or 74 of fresh food compartment 70, or even in the upper planar surface 72 of fresh food compartment 70 of refrigerator 60. Other cross-sectional configurations for support members 100 and 102 could be utilized, as well as the support members 100 and 102 could be formed as at least two separate support members, which do not run the entire width W (FIG. 3) of sidewall member 96*a* (FIG. 3). Housing 91 could also be formed of other materials, other than a suitable plastic material, such as by stamping, or otherwise forming, housing 91 from a thin sheet of aluminum, or stainless steel. Replaceable filter 92 could also have other shapes, and cross-sectional configurations other than the thin pad-like, rectangular shape illustrated in FIG. 1A and FIGS. 2–5. The number and shape of the openings 105, 106 could similarly be varied. Other releasable connectors 94 other than the VELCRO® hook and loop fasteners could be utilized, provided they have a similar low cost, and may be readily, and easily, released to permit the housing to be easily and readily disconnected from the fresh food compartment.

Thus, it is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

What is claimed is:

1. For use in a refrigerator having a fresh food compartment, having a plurality of planar wall surfaces, and a freezer compartment with an air return passageway disposed in fluid communication between the fresh food compartment and the freezer compartment, an air filter system for filtering at least some of the air flowing from the fresh food compartment through the air return passageway into the freezer compartment, comprising:

a housing having an interior defined by a plurality of wall members formed integral with each other, each wall member having an inner surface and an outer surface;

at least two of the wall members having integrally formed on each of their inner surfaces at least one support member;

a replaceable air filter supported by the at least two support members, the air filter being disposed intermediate at least one opening formed in the housing and the air return passageway;

at least one mounting member formed integral with at least one wall member, the at least one mounting member having a mounting surface lying in a plane which is substantially coplanar with at least one of the planar wall surfaces of the fresh food compartment; and a releasable connector disposed on the mounting surface of the at least one mounting member which releasably connects the housing to at least one of the planar wall surfaces of the fresh food compartment, whereby upon disconnecting the housing from the fresh food compartment the air filter may be easily replaced.

2. The air filter system of claim 1, wherein the replaceable air filter is a ceramic filter.

3. The air filter system of claim 1, wherein the replaceable air filter is a charcoal filter.

4. The air filter system of claim 1, wherein the replaceable air filter is a carbon filter.

5. The air filter system of claim 4, wherein the carbon filter is polypropylene fibers impregnated with carbon.

6. The air filter system of claim 1, wherein the replaceable air filter has a generally rectangular shape.

7. The air filter system of claim 1, wherein the releasable connector includes hook and loop fasteners, at least one of the hook or loop fasteners secured to the mounting surface of the at least one mounting member and at least one of the other hook or loop fasteners being adapted to be secured to at least one of the planar wall surfaces of the fresh food compartment.

8. The air filter system of claim 7, including two mounting members, and a releasable connector is disposed on each mounting surface of each mounting member.

9. The air filter system of claim 1, wherein the at least one mounting member extends outwardly from the at least one wall member.

10. The air filter system of claim 1, wherein the at least one mounting member extends inwardly into the housing.

11. The air filter system of claim 1, wherein the wall members defining the housing include two side wall members and a front wall member.

12. The air filter system of claim 1, wherein the inner surface of each side wall member has at least one support member integrally formed thereon.

13. The air filter system of claim 12, wherein the support members are disposed substantially perpendicular to a substantially perpendicularly disposed planar wall surface of the fresh food compartment.

14. The air filter system of claim 12, wherein there are upper and lower support members formed internally on the inner surface of each side wall member.

15. A refrigerator, comprising:

a fresh food compartment, having a plurality of planar wall surfaces; a freezer compartment with an air return passageway disposed in fluid communication between the fresh food compartment and the freezer compartment;

an air filter system for filtering at least some of the air flowing from the fresh food compartment through the air return passageway into the freezer compartment;

the air filter system including a housing having an interior defined by a plurality of wall members formed integral with each other, each wall member having an inner surface and an outer surface;

at least two of the wall members having integrally formed on each of their inner surfaces at least one support member;

a replaceable air filter supported by the at least two support members, the air filter being disposed intermediate at least one opening formed in the housing and the air return passageway;

at least one mounting member formed integral with at least one wall member, the at least one mounting member having a mounting surface lying in a plane which is substantially co-planar with at least one of the planar wall surfaces of the fresh food compartment; and a releasable connector disposed on the mounting surface of the at least one mounting member which releasably connects the housing to at least one of the planar wall surfaces of the fresh food compartment, whereby upon disconnecting the housing from the fresh food compartment the air filter may be easily replaced.

16. The refrigerator of claim 15, wherein the replaceable air filter is a ceramic filter.

17. The refrigerator of claim 15, wherein the replaceable air filter is a charcoal filter.

18. The refrigerator of claim 15, wherein the replaceable air filter is a carbon filter.

19. The refrigerator of claim 18, wherein the carbon filter is polypropylene fibers impregnated with carbon.

20. The refrigerator of claim 15, wherein the replaceable air filter has a generally rectangular shape.

21. The refrigerator of claim 15, wherein the releasable connector includes hook and loop fasteners, at least one of the hook or loop fasteners secured to the mounting surface of the at least one mounting member and at least one of the other hook or loop fasteners is secured to at least one of the planar wall surfaces of the fresh food compartment.

22. The refrigerator of claim 21, including two mounting members, and a releasable connector is disposed on each mounting surface of each mounting member.

23. The refrigerator of claim 15, wherein the at least one mounting member extends outwardly from the at least one wall member.

24. The refrigerator of claim 15, wherein the at least one mounting member extends inwardly into the housing.

25. The refrigerator of claim 15, wherein the wall members defining the housing include two side wall members and a front wall member.

26. The refrigerator of claim 25, wherein the inner surface of each side wall member has at least one support member integrally formed thereon.

27. The refrigerator of claim 26, wherein the support members are disposed substantially perpendicular to a substantially perpendicularly disposed planar wall surface of the fresh food compartment.

28. The refrigerator of claim 26, wherein there are upper and lower support members formed internally on the inner surface of each side wall member.

* * * * *